United States Patent [19]

Dutkovich

[11] 4,176,252

[45] Nov. 27, 1979

[54] MULTI-DIMENSIONAL AUDIO PROJECTOR

[75] Inventor: Steven J. E. Dutkovich, Los Angeles, Calif.

[73] Assignee: Dutko Incorporated, Los Angeles, Calif.

[21] Appl. No.: 854,041

[22] Filed: Nov. 22, 1977

[51] Int. Cl.[2] ..... H04R 5/00

[52] U.S. Cl. ..... 179/1 G; 179/1 GQ; 179/100.1 TD

[58] Field of Search ..... 179/1 G, 1 GQ, 1 GP, 179/1 GA, 100.1 TD, 100.4 ST; 84/DIG. 1

[56] References Cited

U.S. PATENT DOCUMENTS

| | | | |
|---|---|---|---|
| 3,665,105 | 5/1972 | Chowning | 179/1 GQ |
| 3,757,046 | 9/1973 | Williams | 179/1 G |
| 3,873,779 | 3/1975 | Wedan | 179/1 GQ |
| 3,969,588 | 7/1976 | Raydon et al. | 179/1 G |
| 3,982,071 | 9/1976 | Weiss et al. | 179/1 GQ |

*Primary Examiner*—Kathleen H. Claffy
*Assistant Examiner*—Gerald L. Brigance
*Attorney, Agent, or Firm*—Lyon & Lyon

[57] ABSTRACT

Apparatus for projecting movement of audio signals employs a plurality of variable-gain amplifier stages, the gain thereof being controlled by the states of an associated plurality of counters and decoders, to provide a spatial distribution of audio signals in such a manner that the signals are perceived as having a variety of geometric configurations, which configurations may be either dynamic or static. The apparatus is suitable for use with recorded or "live" audio signals. Various alternatives are also disclosed, including a sequencing circuit for allowing automatic variation of amplifier gain in response to various components of the audio signal itself. The apparatus may be configured for connection directly to power amplifiers, or for connection to recording devices.

20 Claims, 7 Drawing Figures

FIG. 1.
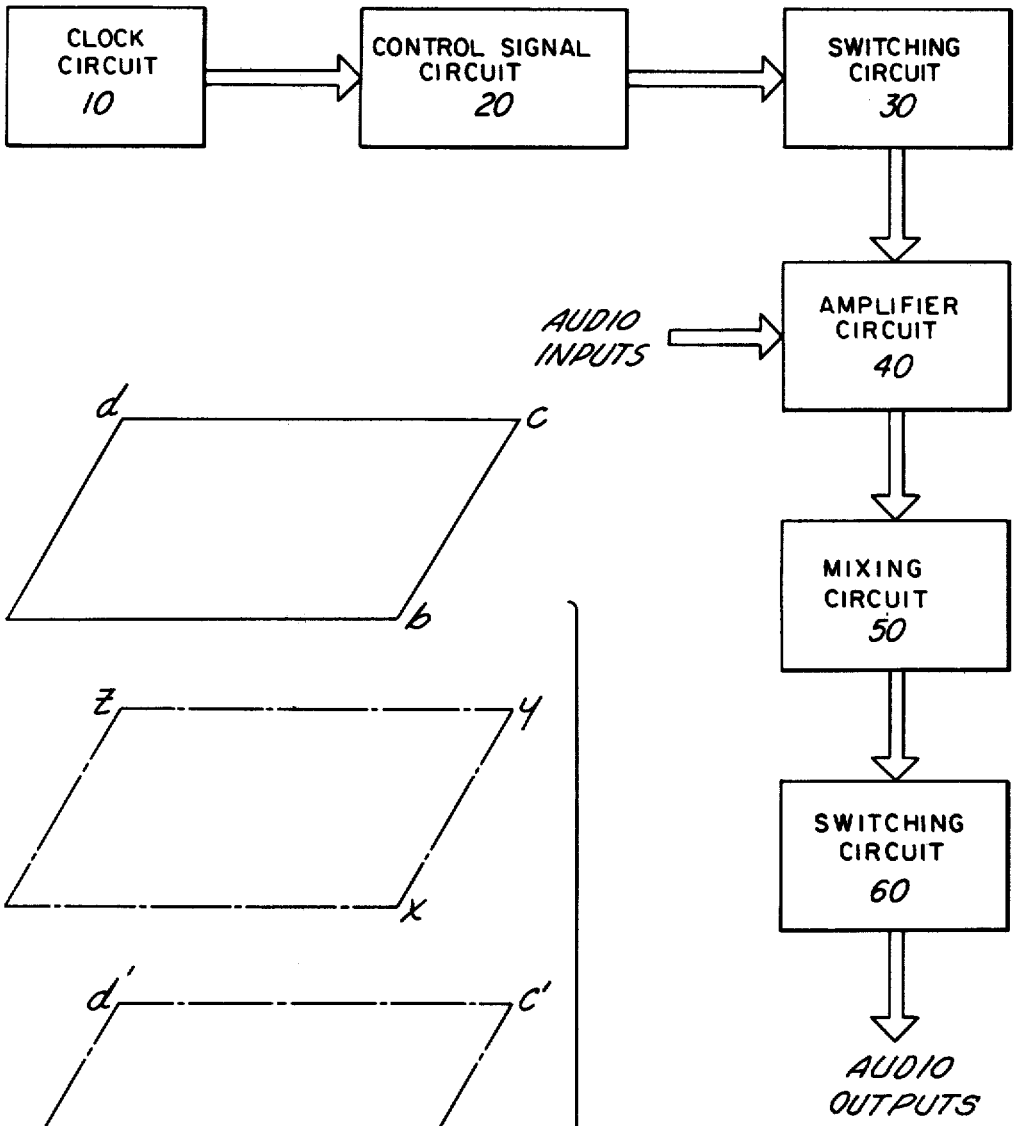
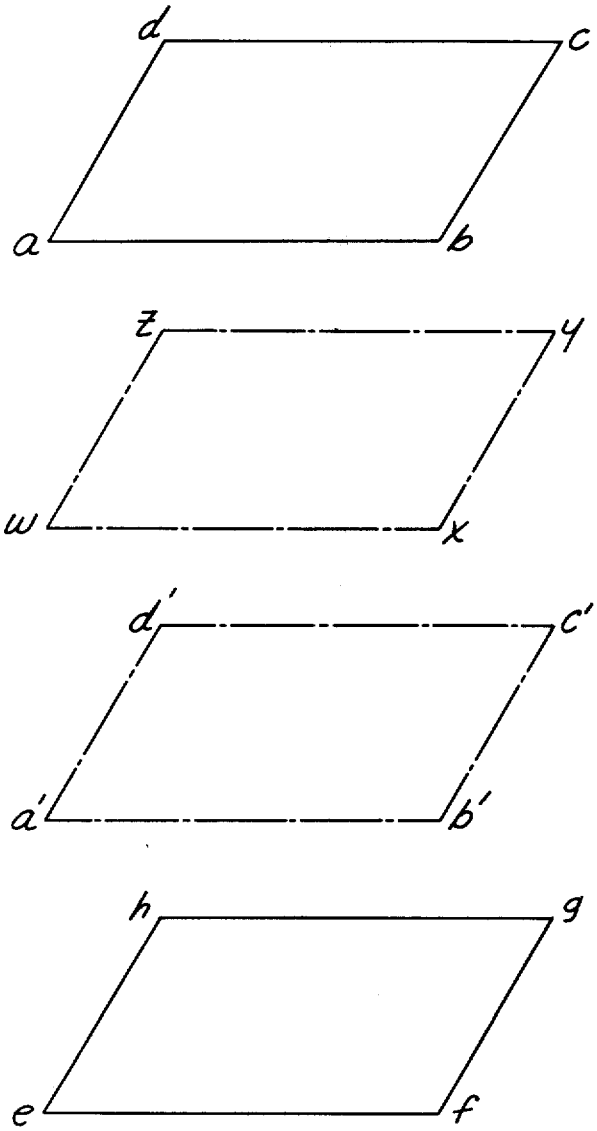
FIG. 4.

MULTI-DIMENSIONAL AUDIO PROJECTOR

BACKGROUND OF THE INVENTION

This invention relates generally to audio signal processing systems; and more particularly to signal processing systems involving movement of such signals.

Music, whether it be classic, folk, rock, pop, or another form, has long interested audiophiles, both in its "live" form and recorded arrangements. One of the most difficult tasks in recent years has been to convey the musician's art to all portions of his audience in a manner which pleases each portion thereof, whether the musician's art is "live" or recreated.

Where the music is live, most efforts have been directed to distributing the sounds to all portions of the audience uniformly, so that each member of the audience hears substantially the same sounds, at any given moment, as every other member of the audience. However, the inherent limitations of two- and four-channel systems have prevented each member of the audience from experiencing the same sounds as any other member of the audience. More particularly, listeners placed, respectively, closer to a first speaker system and a second speaker system will hear substantially different sounds, assuming that the signals provided thereto are at least stereo. Thus, the optimum signal is perceived from only limited positions of the audience.

In recreating recorded music, the effort has thus far been directed to reproducing the "live" performance. This of course has the attendant limitations of limited optimum listening positions, although it is possible to adjust the amplifiers and speaker systems to provide optimized listening at a given location. Nevertheless, other positions in the listening space are non-optimum; thus, despite the adjustable nature of the system, substantial limitations still exist.

In connection with the typical, unachieved concept of distributing the sound equally to each listener, it has been usual to maintain at as constant level as possible the audio signal to each channel, varying levels only as necessary to accurately recreate the live performance. In some instances, the number of channels has been increased, e.g., "quad", as shown in Iida U.S. Pat. No. 3,725,586. In some instances, however, the signals to the various channels have been varied to attempt to provide "movement" of the sound, as for example in Raydon U.S. Pat. No. 3,969,588; Wedan U.S. Pat. No. 3,873,779; Weiss U.S. Pat. No. 3,982,071; and Williams U.S. Pat. No. 3,757,046. Other devices have employed phase shifting circuits to provide azimuth representations, as for example Gerzon U.S. Pat. No. 3,997,725. In other instances, loudspeakers have been arranged to give the illusion of fullness, or naturalness, by disposing the loudspeakers in a three dimensional arrangement, as for example Bucky U.S. Pat. No. 2,179,840 and Schaeffer U.S. Pat. No. 2,636,943.

However, each of these systems suffers from a variety of limitations. Typical of these limitations are lack of smooth transitions between speaker systems, and limited forms of movement. In addition, movement of a plurality of independent signals through three dimensions has heretofore not been possible. Also, in those systems which have involved rudimentary sound movement techniques, such movement has been preselected or fixed, and not dynamic. Because of these and other limitations, there has been a need for an improved audio imaging device.

SUMMARY OF THE INVENTION

In one embodiment of the invention, a clock circuit is employed to drive a plurality of bidirectional counters. The counters in turn drive associated decoders which control the gain of an associated plurality of voltage-controlled amplifiers. The count signals provided by the counters to the decoders cause the output signals of the voltage-controlled amplifiers to increase (or decrease). The voltage-controlled amplifiers receive audio inputs from either a live or recorded source and provide audio signals to conventional power amplifiers, which drive suitable transducers such as loudspeakers or the like.

By appropriately arranging the sequence by which the signals of the voltage-controlled amplifiers are increased or decreased, the signals supplied to the transducers may be altered to provide the listener with the perception of movement of the resulting sounds. By properly ordering the sequence by which signals are supplied to the transducers, a variety of patterns of movement may be produced.

To provide three dimensional patterns, the preferred embodiments employ at least eight channels of output arranged in a spatial distribution, as for example at the verticles of a rectangular solid. With this arrangement the variety of potential patterns which may be generated becomes virtually limitless. In addition to two dimensional movements, it is possible to provide for projection of audio images such as spheres and other complex three dimensional images.

In addition to the significant advantage provided by the present invention of three dimensional images, it is also possible with the present invention to automatically vary the image being generated at any given moment. This may be accomplished either by a frequency selective circuit which detects a selected instrument and alters the pattern in response to that signal, or by a random function generating circuit, or by the use of multiple clocks to supply the counter stages, or any of a variety of other means. Provision may also be made for manual control of the patterns to be generated.

It is also possible with the present system to divide each audio input into frequency components, and separately distribute each component in any of the same movements previously described. Likewise, various other effects such as reverb, equalization, and so on may be accomplished.

It can be seen from the foregoing that the present invention provides a variety of advantages in connection with the distribution and reproduction of music. An advantage which also follows from the ability to distribute signals as previously described is that each listener perceives the music as having equally good separation and balance, despite variations in spacing between transducers or loudspeakers. Thus the listener is not restricted to a single optimized location, and may move about within a substantial area.

The present invention may also be employed in connection with any conventional multi-channel recording means to provide the same effects when the recording is played back through the appropriate number of amplifiers and loudspeakers. These and other applications of the present invention will be better understood upon consideration of the following detailed description of the invention taken together with the appended figures, the latter being described briefly below.

It is therefore one object of this system to provide an improvement system for causing the listener to perceive movement of the music.

It is a further object of this invention to provide an audio projection system wherein the geometric images provided by the movement of the sound are dynamic.

It is a further object of this invention to provide an improved audio projection system suitable for providing movement of sounds through three dimensions.

It is another object of this invention to provide an audio projection system wherein the images generated by the movement of the sounds are determined by features of the audio signal itself.

THE DRAWINGS

FIG. 1 is a schematic diagram of the functional blocks of one embodiment of the present invention.

FIGS. *2a–2d* are a detailed schematic diagram of one embodiment of the present invention.

FIG. 3 illustrates the timing waveforms which control transitions from one channel to the next.

FIG. 4 schematically illustrates one arrangement of a plurality of output transducers suitable for use with the present invention, and indicates one manner of signal distribution.

DETAILED DESCRIPTION OF THE INVENTION

Figure 2A:
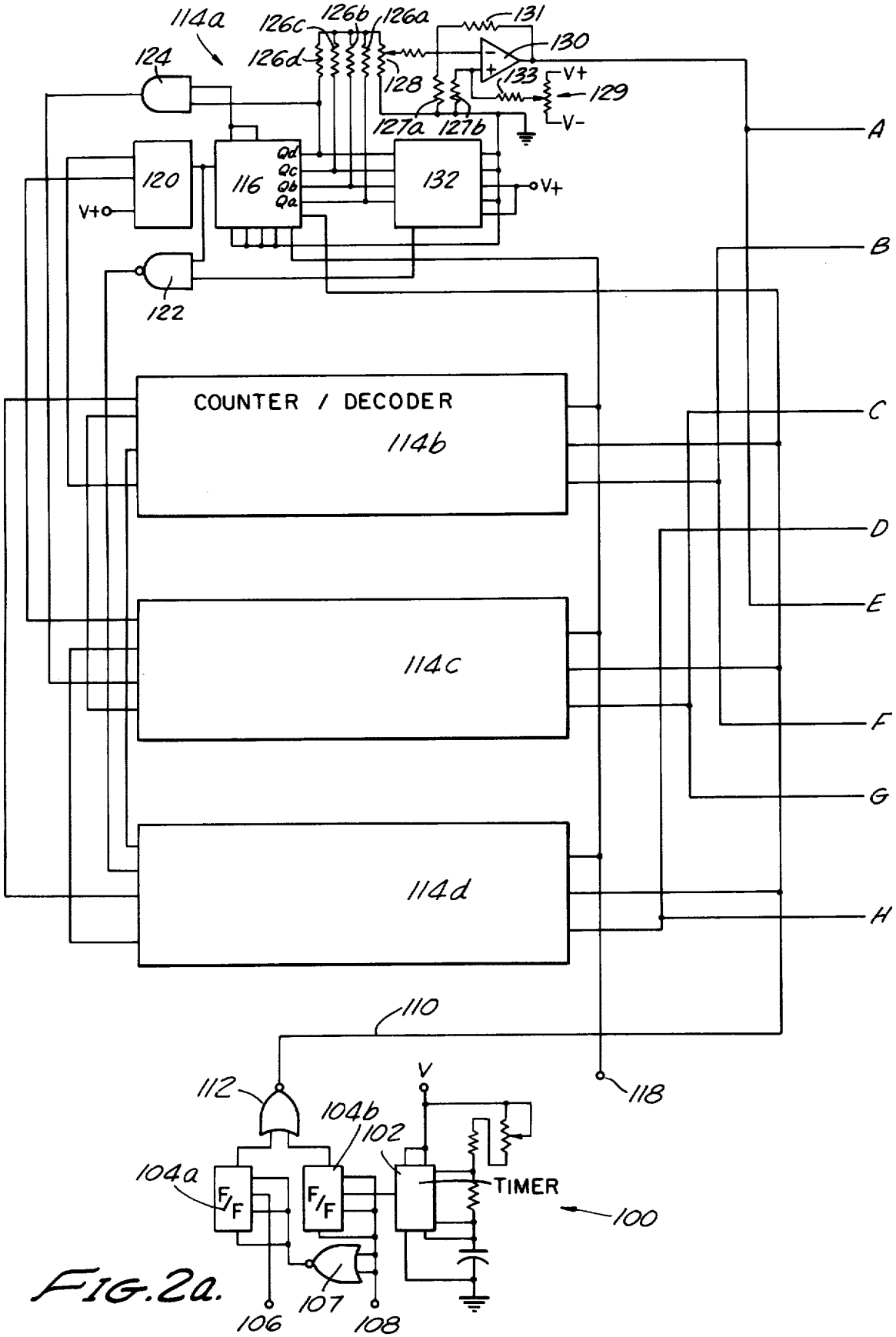

Attention is now directed to FIG. 1, which is a schematic diagram of the functional blocks of one embodiment of the present invention. A clock circuit 10 provides at least one timing signal to a control signal circuit 20, which preferably includes a plurality of counter-decoder stages as described in more detail in connection with FIGS. *2a* and *2b*. In response to the timing signal, the control signal circuit 20 generates a series of signals of incremental variation ranging in magnitude from a low voltage level to a high voltage level.

The signals from the control signal circuit 20 are then provided, through a switching circuit 30, to a variable gain amplifier circuit 40. The variable gain amplifier circuit 40 preferably includes, as will also be discussed in connection with FIGS. *2a–2b*, a plurality of variable gain amplifier stages. The input of each amplifier stage is connected to an audio input, and the gain control line of each amplifier stage is connected to an associated counter-decoder stage. The incrementally varying signals provided by the counter-decoder stages can thus be seen to control the amplitude of the audio signal produced at the output of each amplifier stage. While this gain preferably varies within a range of unity to substantially zero, those skilled in the art will recognize that the maximum gain may be any stable amount.

The outputs of the amplifier circuit 40 are then provided to a series of mixing amplifiers which comprise a mixing circuit 50. The interconnection of the amplifier stages of the variable gain amplifier circuit 40 and the mixing circuit 50 is important to an understanding of the present invention, and will be explained in detail in connection with FIG. *2c*. The mixing circuit 50 then provides its plurality of outputs to an equal number of output devices (not shown) through a switching circuit 60. The switching circuit 60 includes a plurality of independently actuable switches, one switch for each audio output, and functions to reorder the interconnection of the mixed outputs and the output devices. As will be better appreciated hereinafter, the output devices may be conventional power amplifiers for driving conventional transducers such as loudspeakers; or the output devices may be recording amplifiers for recording the multichannel output on recording media such as tape or disc.

As will be more apparent from FIGS. *2a–2c*, by controlling the sequence in which the variable gain stages of the variable gain amplifier circuit allow the associated audio signals to pass therethrough, the audio signals are perceived as having movement in addition to other phonic qualities. This may be most readily understood if it is assumed that the output devices shown in FIG. 1 are conventional power amplifiers and loudspeakers, and the loudspeakers are distributed throughout a three-dimensional space such as a listening room, with one speaker (and associated output signal) at each of the eight vertices of that room, as shown in FIG. 4.

With the output devices in this configuration, it can be seen that proper sequencing of the control signals to the variable gain amplifiers 40 may cause the audio signals to be moved through the room in a nearly infinite variety of three-dimensional patterns as the audio signals are removed from a first output device and applied to a second output device. This effect can be duplicated by recording the signals by a conventional multichannel recording means, and simply reproducing the recorded signals through conventional playback means having the appropriate number of channels.

Referring now to FIGS. *2a–2d*, there is shown therein a detailed schematic diagram of one embodiment of the present invention, which operates on a conventional stereo (two input) signal to provide a variety of movements of the audio signals as distributed among eight output channels; this embodiment may readily be expanded to operate on as many channels as desired. Also, while the embodiment shown comprises dedicated hardware, those skilled in the art will recognize that the present invention may be implemented in microprocessor form, as will be further detailed hereinafter. Referring first to FIG. *2a*, there is generally indicated a clocking circuit 100, which may be comprised of a timer 102 such as the NE555 and associated biasing circuitry, together with a plurality of divider stages such as flip-flops 104*a* and *b*. The frequency of the clock signal is preferably within the range of 10–150 cps, although those skilled in the art will recognize that any frequency in a much wider range is suitable. An external clocking signal may be provided to the flip-flop 104*a* on line 106, with a line 108 being provided to flip-flop 104*b* to select either the external clock supplied on line 106 or the internl clock. The select signal on flip-flop 104*b* is connected to flip-flop 104 through a NOR gate 107.

The outputs of the respective flip-flops may then be provided to the remaining circuitry through a second NOR gate 112 via a line 110. The line 110 communicates with a plurality of counter-decoder circuits 114*a–d*, and more particularly communicates with a counter 116 included therein. It will be appreciated that each of the circuits 114*a–d* is identical, although the preset inputs for each circuit may be different, as will be seen hereinafter. Therefore only one of these circuits (114*a*) will be described in detail; each circuit includes a counter 116 and a decoder 132, together with additional circuitry the purpose of which is made clear hereinafter.

The counter 116 may be a conventional up-down four bit counter such as the type 74191 distributed by a number of semiconductor manufacturers. The line 110 is connected to the clock input of the counter 116. The data, or preset inputs of the counter 116 are tied low (or, data word 0000), while the load input is tied to a reset line 118, the function of which will be discussed in greater detail hereinafter. The up-down enable line is tied to a buffer flip-flop 120, which may be a conventional D-type flip-flop. The D input of the flip-flop 120 is preferably tied high, with the Q output thereof being connected to the appropriate input of the counter 116, and also connected to one input of a two input NAND gate 122. The ripple clock and max/min outputs of the counter 116 are coupled together and connected to one input of a two input NAND gate 124. As noted previously, the preset inputs (or data words) for each circuit 114*a–d* may differ. Thus, the data word for circuit 114*a*, or 0000, may be 0010 for circuit 114*b*, and may be 1111 for circuits 114*c–d*. It will be apparent that this preset data word controls the initial counting state of each counter. It has also been found advantageous to connect the "set" input of the D-flip-flop in circuit 114*b* to the load input of the counter of circuit 114*b*, to avoid lock-up.

The outputs of the counter 116 are provided to respective terminals of a plurality of binary weighted resistors 126*a–d*. More specifically, the $Q_a$ output of the counter 116 is connected to the largest of the resistors, 126*a*, which may for example, be 4 KΩ. Likewise, the $Q_b$ output of the counter 116 may be connected to a 2 KΩ resistor 126*b*, while output $Q_c$ is connected to a resistor 126*c* having a value of 1 KΩ, and output $Q_d$ is connected to a 500 Ω resistor 126*d*. The remaining terminals of the resistors 126*a–d* are connected to one terminal of a balancing potentiometer 128, the wiper arm of which is connected through a resistor to the negative input of an operational amplifier 130. The remaining terminal of the pot 128 is connected to ground. A resistor 131 is connected between the output and negative input of the amplifier 130, and offset resistors 127*a–b* are connected between ground and the amplifier inputs, respectively. Also, the wiper arm of variable resistor 129 is connected to the positive input of the amplifier 130 through a buffer resistor 133. The remaining terminals of the resistor 129 are connected to positive and negative voltage supplies, respectively.

Thus, it can be seen that the counter 116 provides a series of 16 signals at the output of the amplifier 130. By choice of suitable resistors for biasing the amplifier 130, together with a suitable setting of the potentiometers 128 and 131, the signals from the amplifier 130 will provide sixteen steps between and "on" and an "off" status, which will be appreciated more completely in connection with FIGS. 2*b* and 3, discussed hereinafter. For the embodiment shown, the resistor 218 is preferably 1 KΩ, the resistors 127*a–b* are preferably 390Ω, the resistor 129 is 50 KΩ, and the resistor 133 is 10 KΩ. The function of the variable resistors 128 and 129 is to set minimum and maximum levels of the output of the amplifier 130. The resistor 129 adjusts both the minimum and maximum outputs of the amplifier 130, and for the configuration shown should be adjusted when the counter output is 0000. The resistor 128, on the other hand, adjusts only the minimum level and should be adjusted when the counter output is 1111. It will be noted that the counter outputs are taken in "trues complement" form since the amplifier 130 is of the inverting type.

The outputs Q*a*–Q*d* also provide inputs to a magnitude comparator 132. The comparator 132 may be a type 7485, 4-bit magnitude comparator, or other suitable device. The outputs of the counter 116 provide inputs to the B0–B3 lines of the comparator 132. The "A = B" input and the A1 inputs are each tied high, with the remaining inputs tied low. The "A = B" output is connected to the remaining input of the NAND gate 122, in a conventional cascading format. The $Q_d$ output of the counter 116 also provides the remaining input to the AND gate 124.

The clock input of the buffer flip-flop 120 is provided from an AND gate (not shown) included in circuit 114*c* and corresponding to AND gate 124. Similarly, the output of the AND gate 124 of circuit 114*a* provides the clock input to the flip-flop within the circuit 114*c*. It will be appreciated that the order of the outputs and inputs on the circuits 114*b–d* corresponds to their appearance in circuit 114*a*, such that innerconnection therebetween will be readily apparent to those skilled in the art.

The comparator 132 functions in a manner similar to a carry look-ahead. With the arrangement of inputs to the comparator shown, each subsequent stage of the circuits 114 is enabled to begin counting when the previous counter reaches the state 0010, or, when the counter has counted down to two counts from a full on signal at the amplifier 130. The purpose of this arrangement will be better seen from FIG. 3, which illustrates a timing diagram for the respective on and off signals as seen from the output of the amplifier 130.

It will be appreciated that the sixteen steps shown represent the voltage levels provided by the amplifier 130. While sixteen steps has been found to give good results, a different number of increments may also be used simply by varying the clock frequency so long as the number is great enough to provide a smooth transition from full on signals to off signals. The functioning of the comparator 132 results in the offset indicated by the numeral 136 shown by dashed lines connecting timing diagrams 134*a* and 134*b*.

Figure 3:
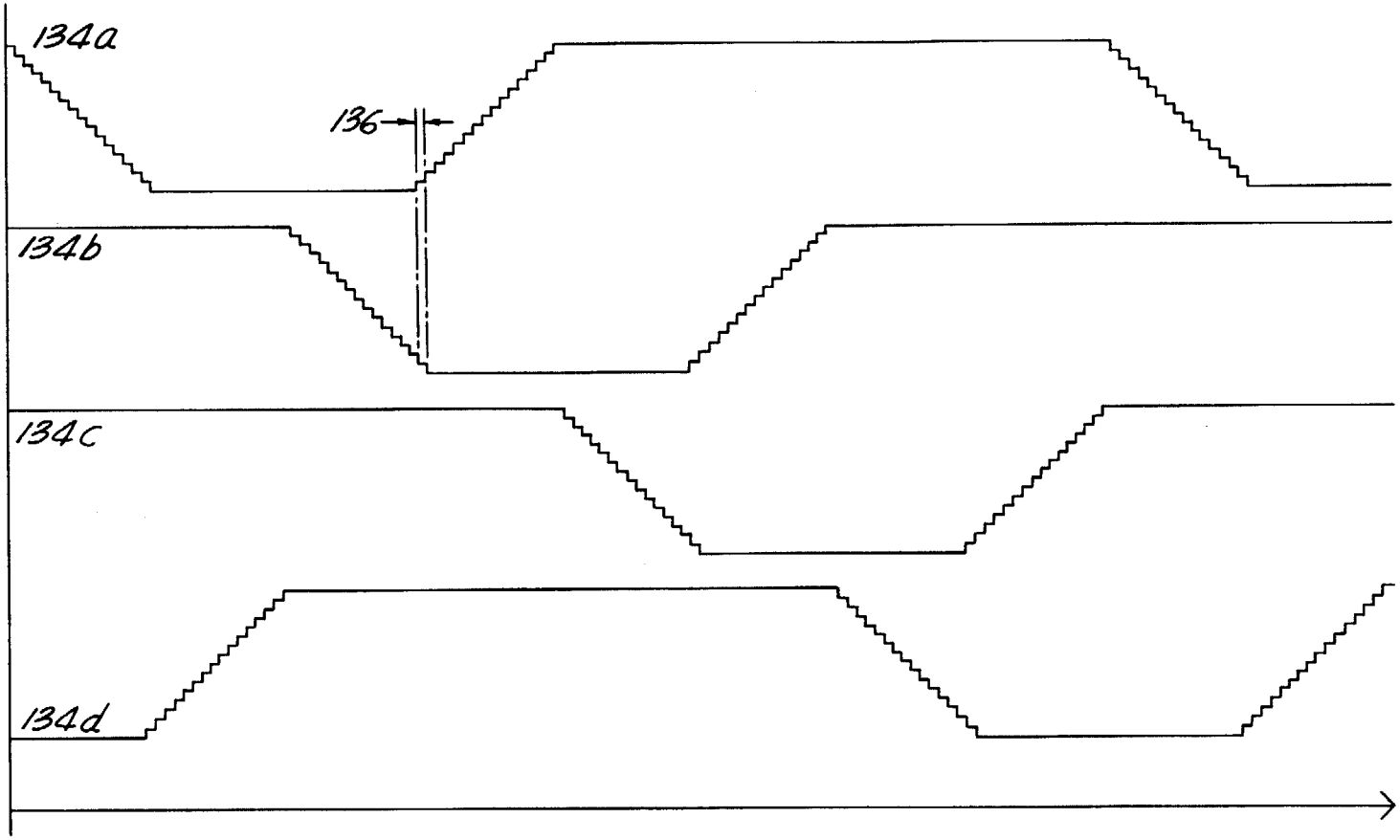

Because of the comparators and associated logic, it will be seen that shortly before the signal 134*b* is turned completely on, the signal 134*a* has begun to turn off, and shortly thereafter the counter driving the amplifier which produces the signal 134*a* increments until that signal is turned off. For purposes of example, the high level signal for each of the timing diagrams of FIG. 3 represents an "off" state, while the low level signal represents an "on" state for the respective amplifier. It can therefore be seen that, due to the comparator 132, before each subsequent stage of the circuits 114 is completely turned on, the preceding stage begins turning off. For the particular system shown, this offset provides approximately a three db reduction relative to "full on" signals to both stages. This provides an improved smoothness in the transition of the sound from one speaker to the next.

Figure 2B:
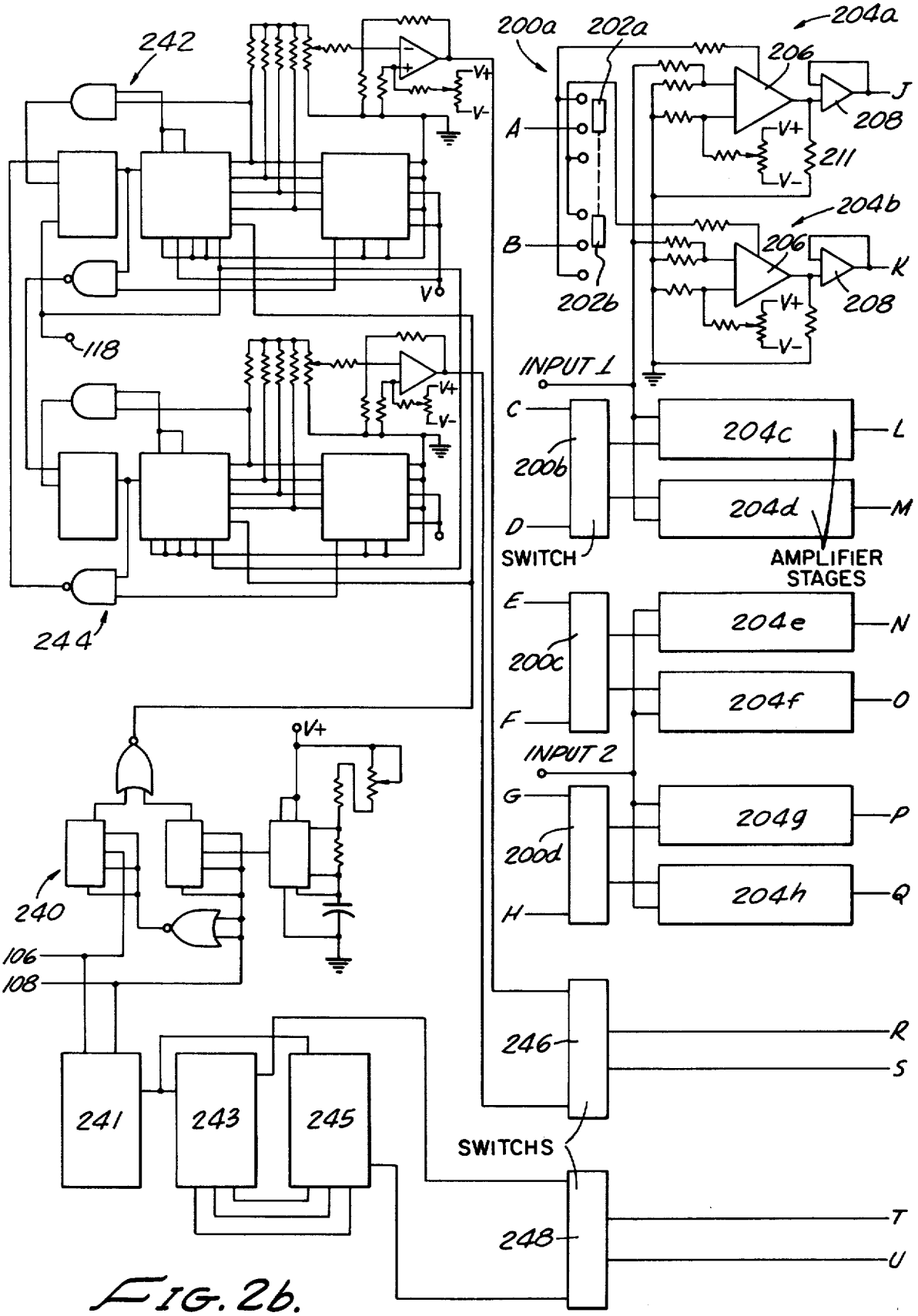

Referring to FIG. 2*b*, which illustrates a second portion of the circuit of FIG. 2*a*, it will be seen that the signals indicated at A–H in FIG. 2*a* connect with the like designated lines for FIG. 2*b*. Thus, the signal from the amplifier 130 is connected to a switching circuit 200*a*, comprised of a pair of associated solid state switches 202*a* and 202*b*. Also, the output from amplifier 130 is connected to an input for switching circuit 200*c*. In a similar manner, the outputs of the amplifier from the circuits 114*b–d* are connected to the switching circuits 200*a–d*. The function of the switching circuits 200*a–d* is to rearrange the order in which the control signals from the amplifiers such as amplifier 130 are provided to variable gain amplifier stages 204*a*–204*h*.

As with the preceding portions of the circuit, only exemplary amplifiers 204a-204b will be discussed in detail, since the remaining amplifier stages are functionally identical.

The amplifier stages 204a-204h are each comprised of a voltage controlled amplifier 206 and associated biasing circuitry, together with a unity gain buffer amplifier 208. The amplifier 206 may be a CA3060 or CA3080, both manufactured by RCA, or other suitable device. With reference again to FIG. 2a, it can be seen that the signal from the amplifier, for example amplifier 130, of the circuits 114a-d is connected to the control line of the associated amplifier 206. In this manner, it can be seen that the sixteen voltage increments provided at the output of the amplifier 130 control the operation of the amplifier 206 to cause the output of the amplifier 206, and therefore the output of the amplifier 208, to range from a substantially off condition to a full on condition. However, it is desired that the amplifier 206 not be entirely turned off, since an initial delay results from a full off condition. As previously noted, proper adjustment of variable resistors 128 and 129 (FIG. 2a) provide for this condition. Further, a potentiometer 210 (FIG. 2b) provides offset adjustment for the amplifier 206.

Audio inputs are provided to each of the amplifier stages 204a-204h from inputs one and two. While only two inputs have been shown, it will be appreciated that any number of inputs may be used. Obviously, eight inputs may be fed directly into the respective amplifier stages; if more inputs are desired, a conventional mix-down circuit may be employed. Or, as will be described further hereinafter, the present invention may be employed as a mixing device.

In this context, the function of the switching circuit 200a-d can better be understood. From the switching circuit 200a, it can be seen that the slide bar of the switches 202a and 202b connects the control line from the circuits 114a-d to the control lines of the amplifiers 206. By actuating the switching circuits 200a-200d, the control signals from the circuits 114a-d will be connected to different amplifier stages 204a-h. In this manner, the order in which the respective audio channels are sequenced on and off may be altered. In conjunction with the remaining circuitry, this permits a choice of forward rotation, reverse rotation, and "figure 8" rotation within a single plane. However, for certain types of material, such as monophonic material, it is desirable to place the switches in such a position that the channels are locked in opposition. An example of a locked-in-opposition arrangement would be to connect the control line output of circuit 104a to the control lines of circuits 204a and 204g, the control line output of circuit 104b to the control lines of circuits 204b and 204h, the control output of circuit 104c to the control line of circuits 204c and 204e, and the control output of circuit 104d to the control line of circuits 204d and 204f. Other equivalent arrangements are also possible.

Figure 2C:
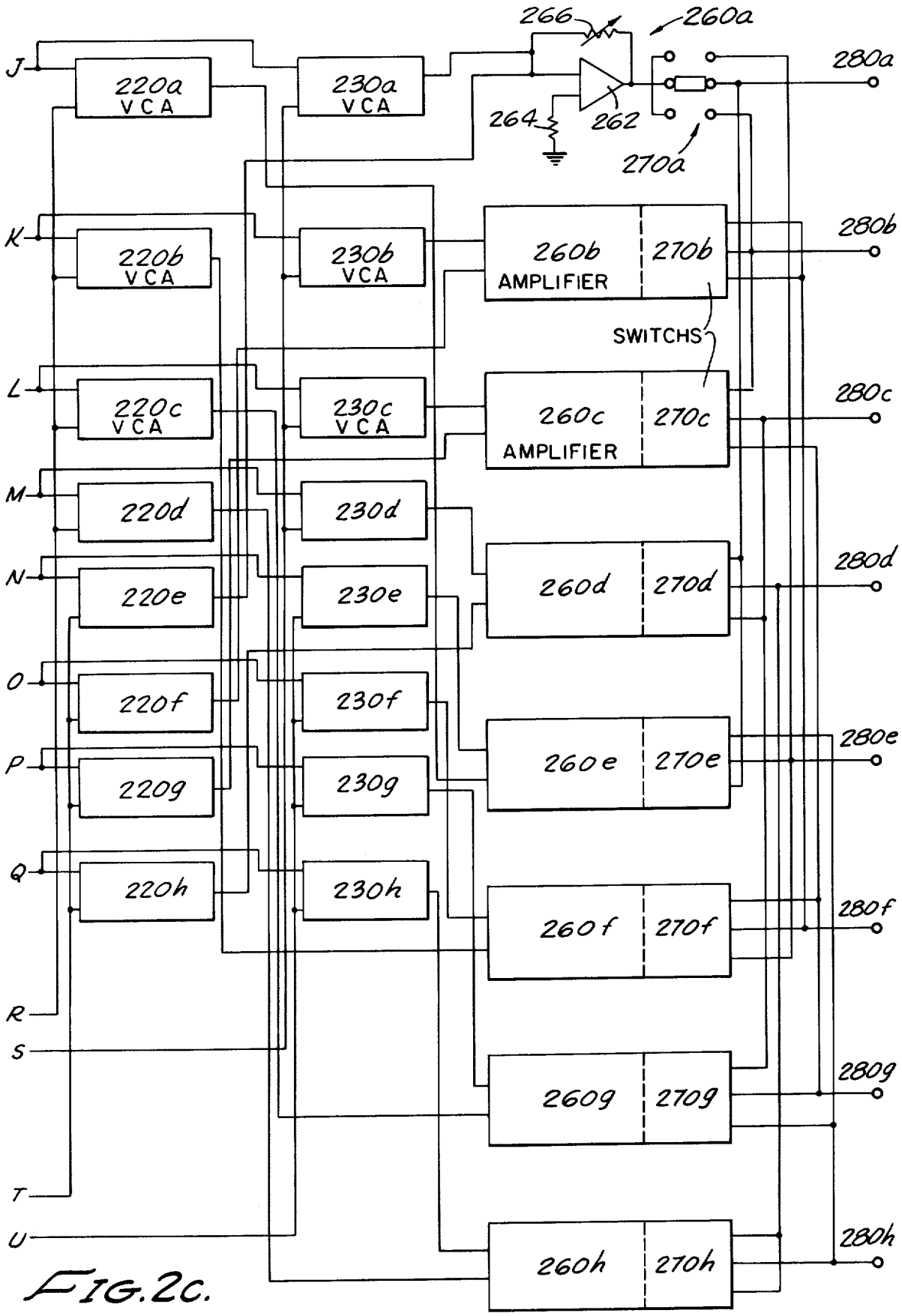

As previously noted, the amplifier stages 204a-h shown in FIG. 2b are suitable for generating a variety of audio movements in a single plane. However, the present invention also provides movement of the sound in three dimensions, as can be appreciated from the circuitry shown in FIG. 2c, taken together with that of FIG. 2b. The interconnections between FIG. 2b and FIG. 2c are at the lines indicated by letters J-U.

A series of amplifier stages, arranged into two groups designated by the numerals 220a-h and 230a-h, provide shifting of the planar representations of the sound, thereby providing three dimensional movement. Each of the amplifier stages 220a-h and 230a-h is functionally identical with the amplifier stages 204, except that the buffer amplifier 208 and the resistor 211 have been removed. Thus, the output for each of the stages 220a-h 230a-h is taken directly from the amplifiers 206 included therein.

However, the amplifier stages 220a-h and 230a-h are clocked independently of the amplifier stages 204a-h. For this purpose, a second clocking circuit 240 and a third clocking circuit 241 are indicated generally in FIG. 2b, each being comprised of circuit components substantially identical with those of clock circuit 100 (FIG. 2a) and operating within the same range of frequencies, although the exact frequency will preferably differ. It will be noted that external clock line 106 and clock select line 108 provided to clocking circuit 100 are also provided to the clocking circuits 240 and 241.

Also similar to the circuit of FIG. 2a, the clocking signals from the circuit 240 are provided to a pair of control signal circuits 242 and 244, each of which is substantially identical with the clocking circuit 114a shown in FIG. 2a. Further, the clocking signals from the circuit 241 are provided to another pair of control signal circuits 243 and 245, shown in black box form since they are functionally identical with circuits 242-245, respectively. The control signals provided by the circuits 242-245 are operated upon by switching circuits 245 and 248, each of which is functionally identical with circuit 200a. In most cases, where two clock circuits and four control signals are used in connection with the amplifiers 220a-h and 230a-h, it is unnecessary to use the switching circuits 246 and 248. Rather, it is preferred to connect the output of the circuit 242 directly to line R, circuit 244 to line S, circuit 243 to line T, and circuit 245 to line U. However, if clock circuit 241 and control signal circuits 243 and 245 are eliminated, switching circuits 246 and 248 may be desired and the outputs of circuits 242 and 244 will each be connected to one input of each of the switching circuits.

The control signals which are then provided on lines R, S, T and U are then provided to the associated voltage controlled amplifiers 220a-h and 230a-h (FIG. 2c) to provide substantially the same function as described in connection with amplifier 204a. The signals from the amplifiers 220a-h and 230a-h are then mixed in amplifier stages 260a-h. Each amplifier stage comprises an amplifier 262 configured to operate at unity gain, as determined by resistor 264 and variable resistor 266, each of which may be nominally 10 KΩ. It will be noted that the inputs to each amplifier stages 260a-h are derived from different signals from amplifier stages 220a-h; for example, the inputs to amplifier 262 are provided by amplifier stage 230a and amplifier stage 220e.

The arrangement by which the outputs of amplifier stages 220a-h and 230a-h are selected for mixing by amplifier stages 260a-h is significant in the operation of the present invention. As will be apparent to those skilled in the art from the foregoing description, when it is desired to have the listener perceive an audio signal as emanating from a point midway between two speakers, a signal which is one increment less than "full on" (or, as previously discussed, approximately 3 db less) is applied to the amplifier driving each of the two speakers. This will be referred to hereinafter as substantially full on. On the other hand, when it is desired to have the listener perceive the sound emanating from the location of a single speaker, only the amplifier associated with that speaker passes a signal, generally at the "full on" level. Variations of these extremes may be used to cause the listener to perceive the sound as emanating from any given point between speakers. By continuously or semi-continuously altering the signals between full on and full off, the sound is perceived by the listener as following a nearly infinite variety of dynamic patterns. It should be noted that actuating the reset line 118 causes each control signal circuit to be set such that all amplifiers receive a substantially "full on" signal. It will further be understood that, given the teachings herein, those skilled in the art will recognize a multitude of variations of the circuitry described which do not depart from the present invention, and are the functional equivalent of the circuitry described.

With the foundation of the foregoing description, the arrangement of mixing amplifiers may be understood. Initially, it should be understood that the eight output channels may be connected to eight speakers *a–h*, defining six planes in three dimensions (i.e., a rectangular solid or the like), as shown in FIG. 4. As previously described, when it is desired that an audio signal be perceived as emanating from a point located midway between two speakers each of the amplifiers which provide the audio signals to those speakers receives a substantially "full on" signal from its associated control circuit. Extending this to three dimensions, a plane may be statically defined midway between the eight transducers or loudspeakers in the room allowing each power amplifier to receive a substantially full amplitude audio signal, simply by actuating the reset line 118. For example, for the arrangement shown in FIG. 4, a plane a'b'c'd' may be defined by allowing a full audio signal to reach each output transducer a–h, since each transducer pair a–e, b–f, c–g and d–h receives their respective signals at substantially full amplitude.

It can readily be seen that the plan a'b'c'd' may be moved vertically by properly attenuating the signals to the transducers in either of the planes abcd or efgh. For example, the plane a'b'c'd' is moved upward by attenuating the signals to the speakers e, f, g and h. However, it may be desired to provide somewhat different information to one plane (for example abcd) than the other (efgh), and it may further be desirable to reverse the information supplied to each plane. That is, it may be desirable to move a plane of information defining the top plane to the bottom plane, while at the same time moving the information correspondingly defining the bottom plane to the top plane.

To accomplish this movement of the audio signals, each plane of audio signals must be able to be "moved" between planes of transducers independently of the movement of the other plane of audio signals. This requires that a second "information plane" be defined, as for example, the plane wxyz shown in FIG. 4. Thus, the audio signals for each information plane must be supplied to each pair of transducers, with the signals to the upper information plane controlled by different variable gain amplifiers than the signals supplied to the lower information plane. It can be seen, therefore, that the signals defining each information plane are provided to all eight output transducers; but at different amplitudes depending on the location of the particular transducer. It is for this purpose that the amplifiers 220*a–h* and 230*a–h* are provided.

As can be seen from FIGS. 2*b–*2*c*, the amplifier stages 220*a–d* define a first ("lower") plane of information based on one audio input channel, while amplifier stages 230*a–d* define a second ("upper") plane of information based on the same audio input. Similarly, amplifier stages 220*e–h* define a first ("upper") plane of information based on a second audio input, while amplifier stages 230*e–h* define a second ("lower") plane of information from the second audio input. Because the control signal lines of each group are controlled from different control circuits, the two groups of voltage-controlled amplifier stages which comprise each information plane may be separately controlled, and therefore each information plane may be moved independently.

However, because the sixteen outputs necessary to define the two information planes are preferably mixed down to eight final outputs, the arrangement of mixing amplifiers shown in FIG. 2*c* is used. In FIG. 2*c*, the outputs of amplifier stages 230*a–d* (which define the "upper" plane for that audio information channel) are mixed with the outputs of amplifier stages 220*e–h* (which define the "upper" plane for the second information channel) in the mixing amplifier stages 260*a–d*, respectively. Likewise, the groups which define the "lower" planes for their respective channels (220*a–d* and 230*e–h*) are mixed in amplifiers 260*e–h*, respectively. Thus, both inforrmation planes are provided to eight output channels, but may be moved independently of one another. While a vertical movement has been described it will be noted that other orientations of planes are equally acceptable. Likewise, while only two information planes have been described, those skilled in the art will recognize that the present circuitry may be readily expanded to provide for more information planes.

Regardless of the original orientation of the information planes, switching circuits 270*a–h* may be provided to alter that orientation. The switching circuits 270*a–h* are each functionally identical to switching circuits 202*a*, and may be connected to the output of the mixing amplifier stages 260*a–h*. Thus, the orientation of the information planes may be accomplished at will, simply by actuating switching circuits 270*a–h*. An arrangement of the output signals which has been found to give particularly pleasing dynamic patterns is to circularly rotate the signals defining one plane of information by 90° relative to the remaining information plane. Thus, output pairs become, for example, ah, dg, cf and be. Also, by appropriate control of both movement of signals within a single information plane, and also movement of the entire information planes, the listener may be caused to perceive the signals as originating outside the space defined by the output transducers.

For some applications of the present invention, the signals provided at the outputs of the switching circuits 270*a–h* provide system outputs 280*a–h*, and may be used as inputs to conventional power amplifier means (not shown), or may be supplied to a conventional multichannel recording device (also not shown). It will be noted that eight outputs are shown; it is believed apparent to those skilled in the art that, given the teachings herein, the number of outputs could be increased as desired. However, for most three dimensional spaces, eight channels of audio signals are sufficient to provide any movement desired. Additional channels may be appropriate for oddly shaped spaces.

Figure 2D:
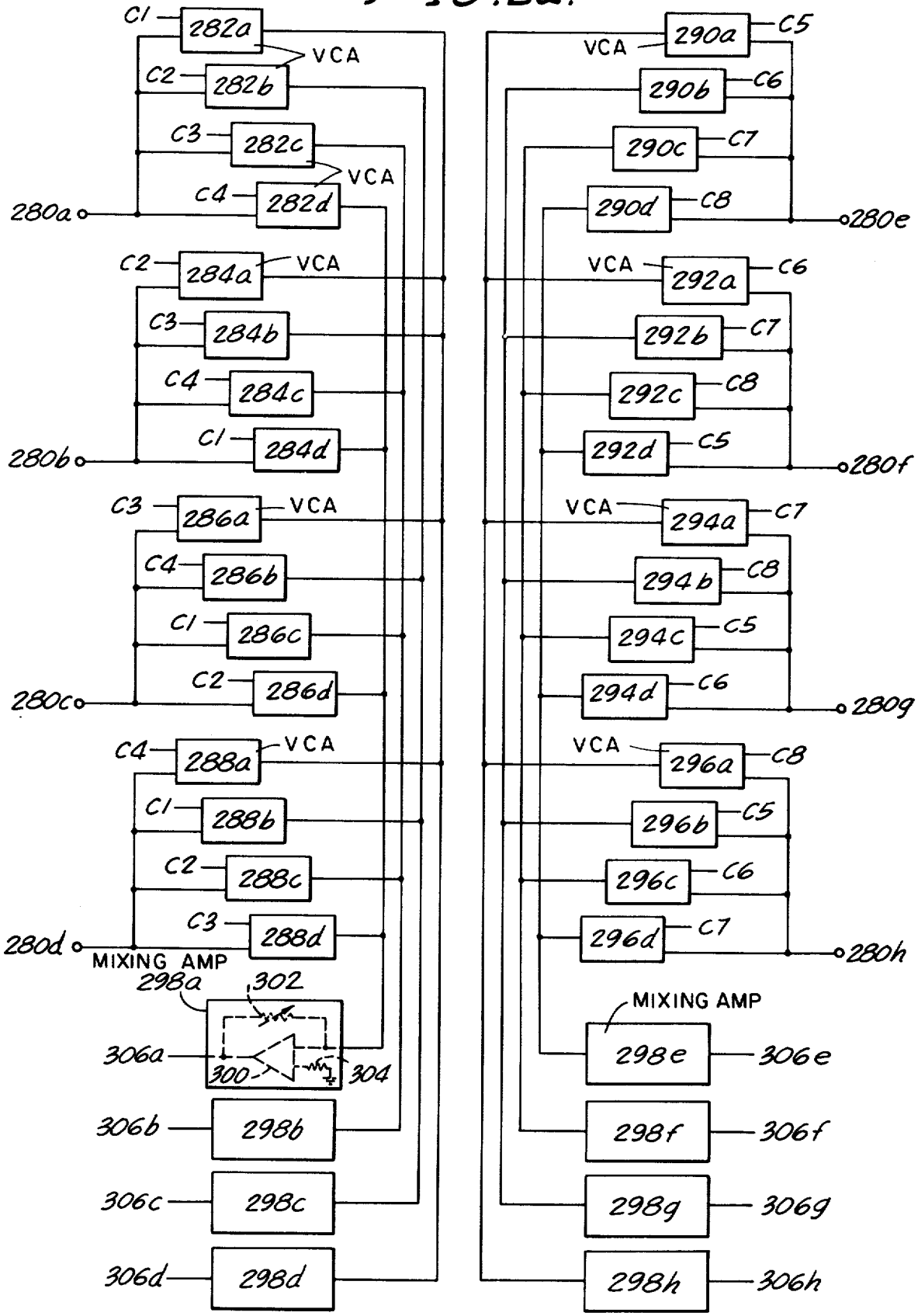

The previously disclosed circuitry, by combining rotational and vector movements in a single plane with a similar array of movements of the plane itself, provides an extensive range of audio movements. For other applications, however, more complex audio movements may be desired. In this connection, FIG. 2*d* is provided to illustrate means for accomplishing a movement of the audio signals which might best be referred to as "spherical rotation." The circuit of FIG. 2*d* may be added to the circuitry of FIGS. 2*a*–2*c* at the system outputs 280*a–h*, and therefore may be seen to be an optional device. In particular, the spherical rotation circuit of FIG. 2*d* comprises eight groups of variable gain amplifier stages, with four amplifier stages in each group. These thirty-two amplifier stages are designated by the indicators 282*a–d*, 284*a–d*, and so on up through 296*1–d*. Each of the variable gain amplifier stages is identical with the amplifier stages 220*a–h* and 230*a–h*.

The outputs of the amplifier stages are combined, in groups of four, for mixing in eight mixing amplifier stages 298*a–h*. Each mixing amplifier stage is functionally identical with amplifier 298*a*, which may be seen to comprise an operational amplifier 300, a variable feedback resistor 302 and a gain setting resistor 304. The resistor 302 is maintained as variable so that the gains of each stage may be mutually balanced, preferably at or near unity gain although acceptable results may be achieved over a wide range of gain. The mixing amplifiers 298*a–h* then provide system outputs to terminals 306*a–h*, which may be utilized in the same manner as terminals 280*a–h*.

To achieve the proper effects, the variable gain amplifiers 282–296 must be controlled in a manner substantially identical to the control of amplifiers 204*a–h*. Thus, another clock circuit (not shown) and a plurality of control signal circuits (also not shown) are provided. In its simplest form, a single clock circuit is employed in combination with four control signal circuits, which are interconnected in a manner analogous to the interconnection of circuits 114*a–d*. Alternatively, two clock circuits, each driving four control signal circuits (or a total of eight) could be used. The eight control signal circuits thus provide eight control lines, designated C1–C8 in FIG. 2*d*. It should further be recognized that other arrangements of clock circuits driving different amplifier groups may also be advantageously employed, to provide still different effects, in a manner similar to clock circuits 240 and 241.

For the effect of spherical rotation to be provided by the circuit of FIG. 2*d*, it can be seen that the arrangement of the control lines into each group of amplifier stages, together with the selection of variable gain amplifier outputs which are combined in the mixing amplifier stages, is most important. As shown in the figure, the control lines C1–C4 and C5–C8 are cycled among the respective halves of FIG. 2*d*. Then, the output of the first amplifier (e.g., 282*a* 284*a*, 2862, 288*a*) of each group is mixed in a single amplifier (e.g., amplifier 298*a*).

By properly controlling the signals on the control lines C1–C8, and with reference again to FIG. 4, the signals provided on lines 280*a–h* may be "moved" in a rotation around the planes abfe and dcgh, or any other pairing of parallel planes, depending on the state of the switches 270*a–h*. By properly modulating the amplitudes of the audio signals, through control lines C1–C8, the listener may be led to perceive the audio signals as emanating from points outside the space defined by the eight vertices, such that the movement of the sound around the parallel planes causes the listener to perceive the movement as resembling a sphere rotating about an axis through the midpoints of the plane. Obviously, the modulation of amplitudes of the audio signals in this manner is susceptible of virtually infinite variation, thus providing a virtually infinite array of movements and related musical effects to be experienced by the listener, which effects may be either static or dynamic.

To further expand the array of patterns possible with the embodiment shown in FIGS. 2*a–d*, the external clock lines 106 may be driven by an external source, for example an automatic sequencing device or a microprocessor, to cause the rates at which the patterns vary to be altered in response to a variety of inputs, for example a keyboard, a preset program, a random function generator, or the music itself.

Of particular interest is the technique of sensing selected characteristics of the audio input signals and altering the sequences generated by the present invention in accordance with those selected characteristics. For example, it may be desired to alter the audio patterns in accordance with the major beats of the audio input, or it may be desired to alter the patterns in accordance with the tempo or amplitude of a selected instrument.

In certain uses, as in studio recording, it may be desirable to isolate one or more instruments or vocalists, and more that isolated input in a manner different from the movements provided for the remaining instrumental and vocal inputs. For such complex movements, a programmable automatic sequencing device (not shown) may be used in combination with the circuitry of the present invention to control the differing movements of each of the audio inputs. As has already been discussed, the embodiment shown in FIGS. 2*a–2d* may be readily expanded to allow for large numbers of audio input signals. In some instances it may be desired to maintain substantially different circuits for particular categories of signals and then to mix those signals with the remaining signals, using an arrangement of mixing amplifiers similar to that shown in either FIG 2*c* or FIG. 2*d*. For example, it may be desirable to move all but the vocals of a particular piece, but have the vocals remain static. This can be accomplished by isolating the vocal input and maintaining constant output amplitudes for that signal, while processing the remaining signals in the manner described hereinabove. From the foregoing it will be apparent that this device has application to live performances in addition to the recording studio and playback areas.

A microprocessor-based control circuit may also be provided for sequencing. Such a device would have the capability of independently controlling a large number of audio inputs and, in conjunction with an appropriate mixing circuit, can cause each such signal to be rotated or otherwise operated upon by the system disclosed herein in any desired manner. For such a system, each audio input would preferably be associated with its own timing and control circuits, as well as its own variable gain amplifier stages, with the outputs thereof being mixed in a manner analogous to that previously described. Alternately, the timing signals may be derived from the microprocessor clock. A keyboard or other manually controlled input may be provided to permit other sequences to be entered, thereby projecting other audio patterns.

Having fully described one embodiment of the invention together with alternative applications, it is to be understood that those skilled in the art will recognize numerous alternatives and equivalents which do not depart from the spirit of the present invention and are intended to be included herein.

I claim:

1. A three-dimensional audio imaging apparatus comprising input means adapted to receive input signals from at least one signal source output means adapted to provide output signals to a plurality of transducers, said transducers being disposed in a three-dimensional space, clock means for providing a train of pulses control signal means including counter means responsive to said train of pulses for supplying control signals determined by the state of said counter means variable amplifier means responsive to said control signal and said input means for distributing signals to said output means to cause said output signals to be perceived as moving through said three-dimensional space said variable amplifier means defining at least two information planes of output signals.

2. The audio imaging apparatus of claim 1 wherein said variable amplifier means includes plane shifting amplifier means and rotational amplifier means, said plane shifting amplifier means being provided to distribute a first component of said output signals among said plurality of transducers and said rotational amplifier means being provided to distribute a second component of said output signals among said plurality of transducers.

3. The audio imaging apparatus of claim 2 wherein said counter means includes plane shifting counter means and rotational counter means.

4. The audio imaging apparatus of claim 3 wherein said clock means includes two clock means, the first of said clock means providing a train of pulses to said plane shifting counter means, and the second of said clock means providing a train of pulses to said rotational counter means.

5. The audio imaging apparatus of claim 1 wherein said counter means comprises a plurality of counting stages, each of said stages adapted to control a predetermined portion of said variable amplifier means, whereby a first of said counting stages causes a second of said stages to count once said first counting stage reaches a predetermined state.

6. The device of claim 1 wherein said first information plane may be moved independently of said second information plane.

7. The device of claim 6 wherein the number of said variable gain amplifiers is at least sixteen, eight of said amplifiers defining the position of said first information plane, and eight of said amplifiers defining the position of said second information plane.

8. The device of claim 7 further including eight mixing amplifiers responsive to said sixteen variable amplifiers for providing eight output signals to said output means.

9. The device of claim 8 wherein the number of said variable gain amplifiers is twenty-four, said eight additional variable gain amplifiers being responsive to said input means and said control signal means, to provide a signal to said remaining sixteen variable gain amplifiers to cause the location of said input signals to be moved within said information planes in accordance with the states of said control signal means.

10. An audio imaging apparatus comprising clock means for providing at least one train of pulses, counter means responsive to said train of pulses for supplying signals determined by the state of said counter means, control signal means responsive to said counter means for supplying a range of control signals, variable amplifier means responsive to said control signals and adapted to receive an input signal and further adapted to provide output signals defining at least two information planes to a plurality of transducers for distributing said output signals to said plurality of transducers to cause said output signals to be perceived as moving.

11. An audio imaging apparatus as in claim 10 wherein said control signal means includes decoding means responsive to said counter means for varying said control signals within said range in response to the state of said counter means.

12. The audio imaging apparatus of claim 11 wherein said counter means includes a plurality of counter stages, said control signal means includes a plurality of control stages, and said variable amplifier means includes a plurality of variable amplifiers.

13. The audio imaging apparatus of claim 12 wherein each said control stage causes its associate variable amplifier to reach an "on" state when its associated counter stage reaches a first predetermined state, and to reach a substantially "off" state when its associated counter stage reaches a second predetermined state.

14. The audio imaging apparatus of claim 13 wherein a first of said plurality of counter stages causes a second of said plurality of counter stages to start counting when the first of said counter stages reaches a third predetermined state, said third state being between said first state and said second state.

15. A multi-dimensional signal distribution device having input means adapted to receive at least one input signal, output means adapted for connection to a plurality of output devices for defining a first information plane, control signal means, variable gain amplifier means responsive to said input means and connected to said output means for amplifying said input to an amplitude determined by said control signal means to move said first information plane.

16. A multi-dimensional signal distribution device having input signal means for receiving at least one input signal, output means adapted to be connected to a plurality of output devices arranged in a three-dimensional space for defining a first information plane, variable gain amplifier means responsive to said input signal means and for providing a plurality of independently variable amplitude output signals to said output means, control signal means for causing said variable gain amplifier means to vary the amplitude of said output signals so as to move said information plane in said three-dimensional space.

17. A multi-dimensional signal distribution device having input signal means adapted to receive at least one input signal, output means adapted to provide at least eight output signals to an equal number of output devices for distribution of said output signals in a three-dimensional space, said output signals defining at least one information plane, control signal means, and at least eight variable gain amplifiers, each amplifier being responsive to said input means and to said control signal means, said control signal means varying the amplification of said input signal by said variable gain amplifiers to move said information plane in predetermined patterns.

18. The device of claim 17 wherein said variable gain amplifiers are controlled by said control signal means to cause said output signals to be spherically rotated.

19. A multi-dimensional signal distribution device having input means adapted to receive a plurality of input signals, output means for providing a plurality of output signals and adapted to be connected to a plurality of output devices distributed through a three-dimensional space, control signal means a plurality of variable gain amplifier means responsive to said input means and said control signal means, and providing a plurality of amplified signals to said output means, said control signal means causing said variable gain amplifier means to vary the amplitude of said amplified signals to cause said output signals, when distributed by said output devices, to appear to rotate through a spherical pattern.

20. A multi-dimensional signal distribution device having input means adapted to receive input signals from at least one signal source output means adapted to provide output signals to a plurality of transducers, said transducers being disposed in a three-dimensional space, first variable amplifier means responsive to said input means for supplying a first set of signals to said output means to define a first information plane, second variable amplifier means responsive to said input means for supplying a second set of signals to said output means to define a second information plane, and control signal means for controlling said first and second sets of signals from said first and second variable amplifier means to move said first and second information planes.

* * * * *